US007653538B2

(12) United States Patent
Katayama et al.

(10) Patent No.: US 7,653,538 B2
(45) Date of Patent: Jan. 26, 2010

(54) PLAYBACK APPARATUS AND PLAYBACK METHOD

(75) Inventors: Taro Katayama, Toyonaka (JP); Toshiya Noritake, Daitou (JP); Kazuo Fujimoto, Shijounawate (JP)

(73) Assignee: Panasonic Corporation, Osaka (JP)

( * ) Notice: Subject to any disclaimer, the term of this patent is extended or adjusted under 35 U.S.C. 154(b) by 893 days.

(21) Appl. No.: 10/544,335

(22) PCT Filed: Feb. 26, 2004

(86) PCT No.: PCT/JP2004/002261

§ 371 (c)(1),
(2), (4) Date: Aug. 3, 2005

(87) PCT Pub. No.: WO2004/077406

PCT Pub. Date: Oct. 9, 2004

(65) Prior Publication Data

US 2006/0080094 A1 Apr. 13, 2006

(30) Foreign Application Priority Data

Feb. 28, 2003 (JP) ..... 2003-052837

(51) Int. Cl.
*G10L 21/02* (2006.01)
*G10L 19/00* (2006.01)

(52) U.S. Cl. ..... 704/226; 704/500; 700/94; 714/746; 370/471

(58) Field of Classification Search ..... 704/500–504, 704/226; 370/505, 471; 714/746; 700/94
See application file for complete search history.

(56) References Cited

U.S. PATENT DOCUMENTS

| | | | | |
|---|---|---|---|---|
| 5,726,989 | A * | 3/1998 | Dokic | 370/509 |
| 6,026,506 | A * | 2/2000 | Anderson et al. | 714/746 |
| 6,173,024 | B1 | 1/2001 | Nanba et al. | |
| 6,363,514 | B1 | 3/2002 | Kawai et al. | |
| 6,631,352 | B1 | 10/2003 | Fujita et al. | |
| 6,788,710 | B1 * | 9/2004 | Knutson et al. | 370/535 |
| 6,804,266 | B1 * | 10/2004 | Kovacevic et al. | 370/505 |
| 6,816,491 | B1 | 11/2004 | Fujii et al. | |
| 7,236,836 | B1 * | 6/2007 | Tanaka et al. | 700/94 |
| 2001/0007568 | A1 * | 7/2001 | Morris | 370/473 |
| 2001/0024447 | A1 * | 9/2001 | Yoshio et al. | 370/421 |
| 2002/0152083 | A1 * | 10/2002 | Dokic et al. | 704/500 |
| 2005/0058145 | A1 * | 3/2005 | Florencio et al. | 370/412 |

FOREIGN PATENT DOCUMENTS

| | | |
|---|---|---|
| JP | 10-209876 | 8/1998 |
| JP | 2000-31942 | 1/2000 |
| JP | 2000-201126 | 7/2000 |
| JP | 2000-259195 | 9/2000 |

* cited by examiner

*Primary Examiner*—Richemond Dorvil
*Assistant Examiner*—Jialong He
(74) *Attorney, Agent, or Firm*—Wenderoth, Lind & Ponack, L.L.P.

(57) ABSTRACT

Noise is prevented when decoding an audio stream not containing syncwords or CRC bits in the elementary stream. When decoding a current frame, the private header of the next frame is analyzed and the current frame is muted if the private header of the next frame is not valid. When there is a data discontinuity caused by editing, decoding resumes from the start address of the next frame determined.

18 Claims, 9 Drawing Sheets

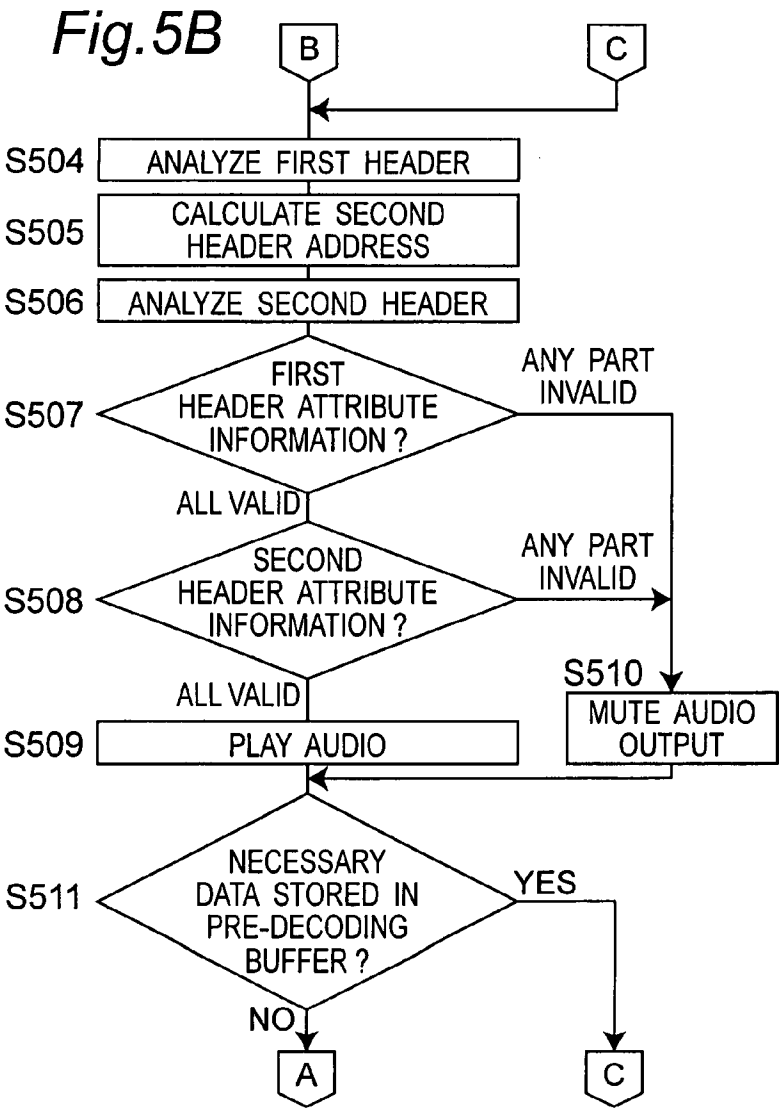
Fig.5B
B
C
ANALYZE FIRST HEADER
S504
CALCULATE SECOND HEADER ADDRESS
S505
ANALYZE SECOND HEADER
S506
FIRST HEADER ATTRIBUTE INFORMATION ?
S507
ANY PART INVALID
ALL VALID
SECOND HEADER ATTRIBUTE INFORMATION ?
S508
ANY PART INVALID
ALL VALID
PLAY AUDIO
S509
S510
MUTE AUDIO OUTPUT
NECESSARY DATA STORED IN PRE-DECODING BUFFER ?
S511
YES
NO
C
A

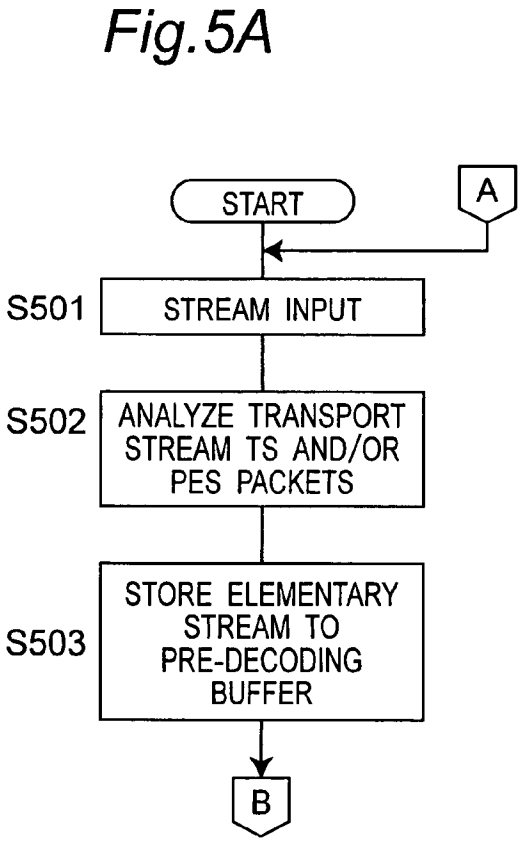
Fig.5A
START
A
STREAM INPUT
S501
ANALYZE TRANSPORT STREAM TS AND/OR PES PACKETS
S502
STORE ELEMENTARY STREAM TO PRE-DECODING BUFFER
S503
B

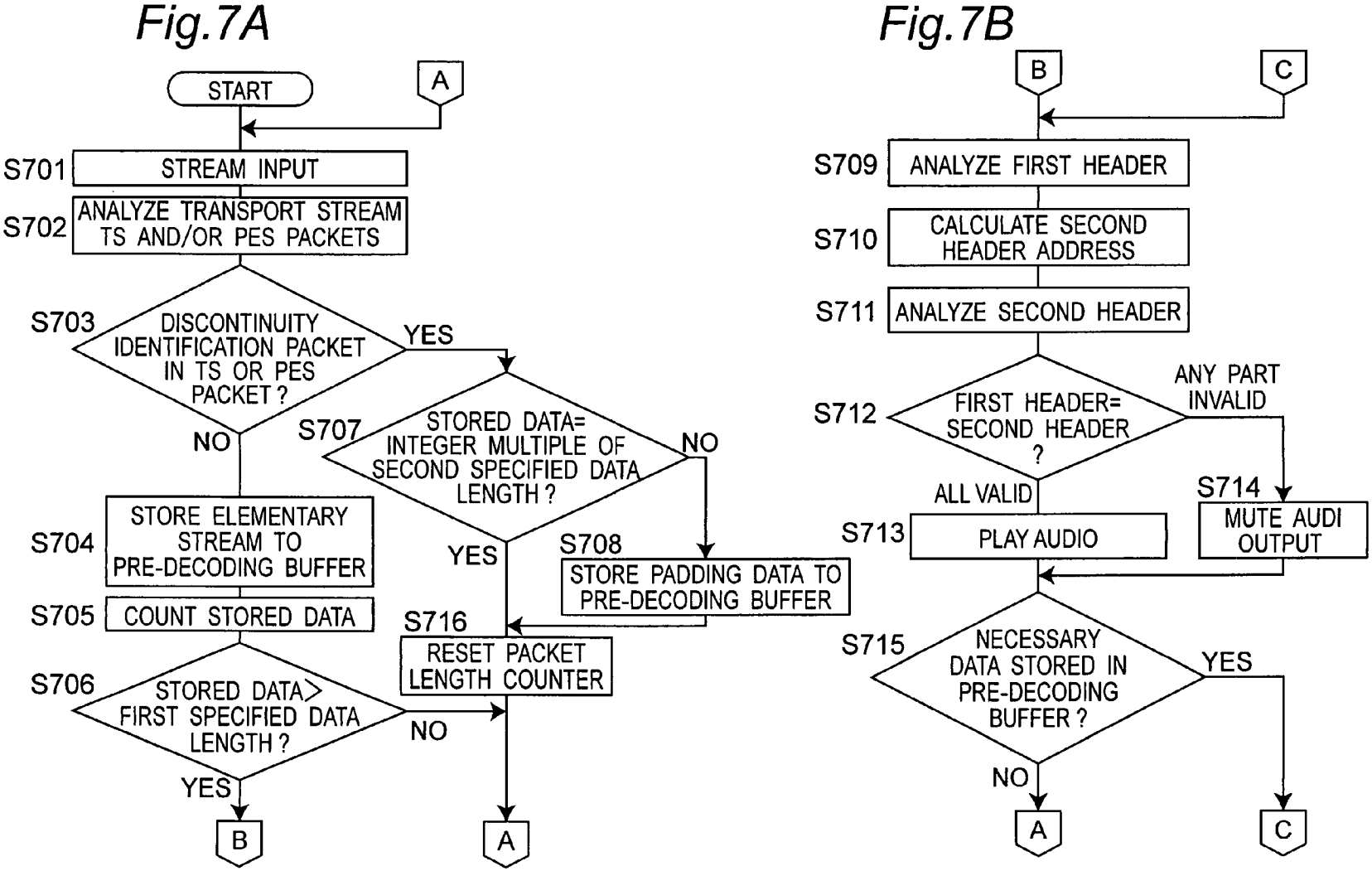
Fig.7A
START
A
STREAM INPUT
S701
ANALYZE TRANSPORT STREAM TS AND/OR PES PACKETS
S702
DISCONTINUITY IDENTIFICATION PACKET IN TS OR PES PACKET ?
S703
YES
NO
STORED DATA= INTEGER MULTIPLE OF SECOND SPECIFIED DATA LENGTH ?
S707
NO
YES
STORE PADDING DATA TO PRE-DECODING BUFFER
S708
STORE ELEMENTARY STREAM TO PRE-DECODING BUFFER
S704
COUNT STORED DATA
S705
STORED DATA> FIRST SPECIFIED DATA LENGTH ?
S706
YES
NO
B
RESET PACKET LENGTH COUNTER
S716
A
Fig.7B
B
C
ANALYZE FIRST HEADER
S709
CALCULATE SECOND HEADER ADDRESS
S710
ANALYZE SECOND HEADER
S711
FIRST HEADER= SECOND HEADER ?
S712
ANY PART INVALID
ALL VALID
MUTE AUDI OUTPUT
S714
PLAY AUDIO
S713
NECESSARY DATA STORED IN PRE-DECODING BUFFER ?
S715
YES
NO
C
A

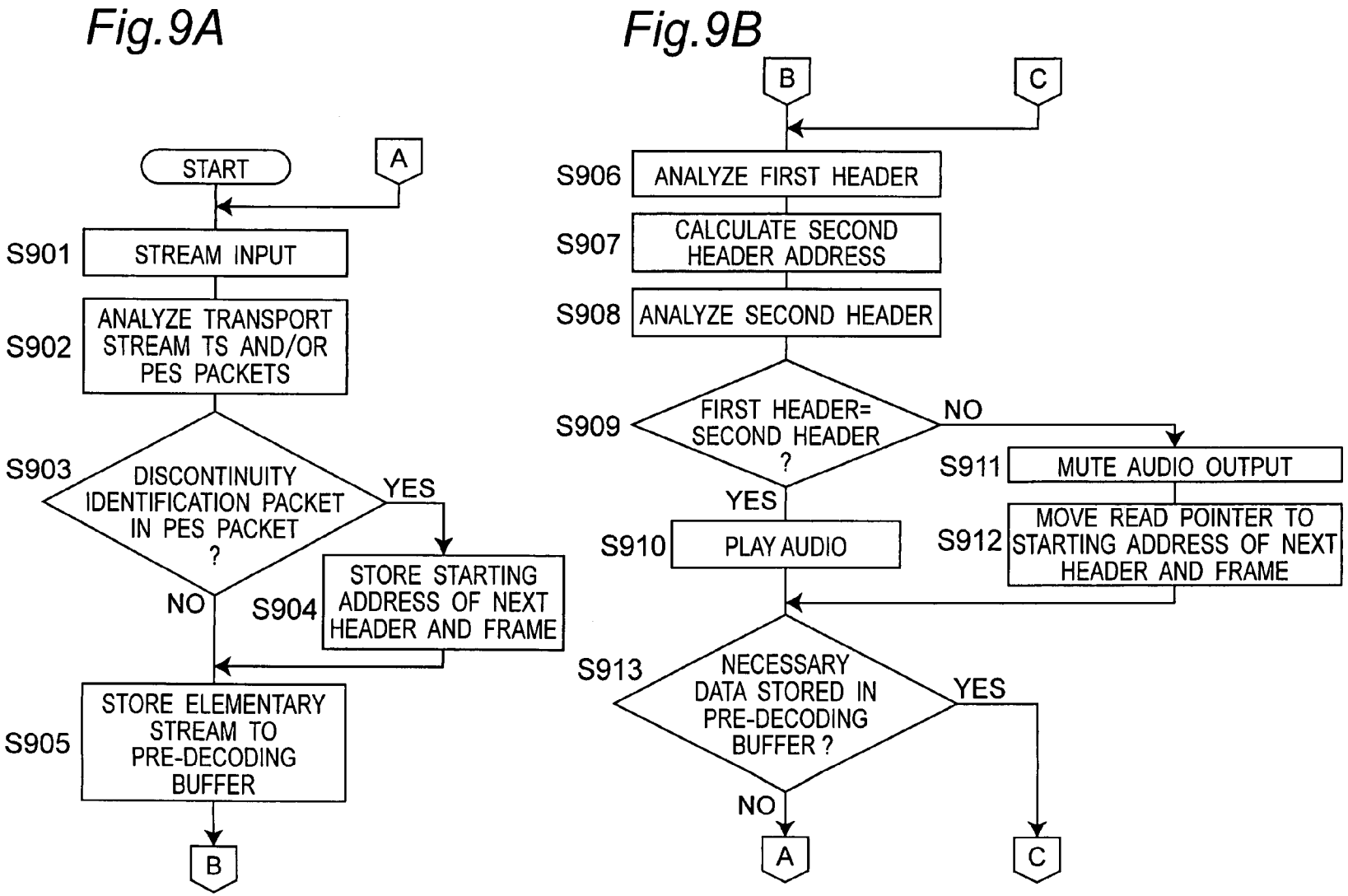
Fig.9A
START
A
STREAM INPUT
S901
ANALYZE TRANSPORT STREAM TS AND/OR PES PACKETS
S902
DISCONTINUITY IDENTIFICATION PACKET IN PES PACKET ?
S903
YES
NO
STORE STARTING ADDRESS OF NEXT HEADER AND FRAME
S904
STORE ELEMENTARY STREAM TO PRE-DECODING BUFFER
S905
B
Fig.9B
B
C
ANALYZE FIRST HEADER
S906
CALCULATE SECOND HEADER ADDRESS
S907
ANALYZE SECOND HEADER
S908
FIRST HEADER= SECOND HEADER ?
S909
NO
YES
MUTE AUDIO OUTPUT
S911
MOVE READ POINTER TO STARTING ADDRESS OF NEXT HEADER AND FRAME
S912
PLAY AUDIO
S910
NECESSARY DATA STORED IN PRE-DECODING BUFFER ?
S913
YES
NO
C
A

PLAYBACK APPARATUS AND PLAYBACK METHOD

BACKGROUND OF THE INVENTION

1. Technical Field

The present invention relates generally to an audio playback apparatus for decoding and reproducing an audio signal encoded in frames, and relates more specifically to a playback apparatus and playback method for reproducing audio without producing noise when attributes change or there is a data discontinuity in the audio signal due to editing or a communication error.

2. Background Art

Playback methods for decoding and presenting audio signals encoded as digital code streams are widely available today in the form of playback devices and computer programs for listening to music and other audio content. In most such implementations the audio signal is encoded in audio data frames according to the MPEG standard, particularly ISO 11172-3 or ISO 13818-3. A private header containing signal attributes is added to each frame. A CRC bit for error checking is also added to the encoded audio signal, thus enabling checking during the decoding process for data errors and data loss on the transmission path.

However, when data loss on the transmission path is high, resulting in discontinuities in the data stream, error correction cannot restore the signal. Outputting the audio signal with such data discontinuities produces noise. To eliminate this noise, the audio is preferably muted.

An example of a conventional playback apparatus is taught in Japanese Unexamined Patent Application Publication 2000-259195. Instead of detecting these signal discontinuities, this playback apparatus detects changes in settings from the transmission side, such as changes in the sampling frequency in the data stream, and mutes audio output for a predetermined time after such a change is detected. When there is such a change, the receiver must automatically adjust to the changed setting, and mutes the audio output so that noise is not produced during the automatic adjustment. This conventional playback apparatus detects a valid header and compares the sampling frequency written to the one previous valid header interpreted by a header interpreting means with the sampling frequency written in the current valid header currently being decoded. If the sampling frequency in the current header has changed, audio is muted for a specific time in the frame following the sampling frequency change to prevent outputting noise.

If the sampling frequency written in the current header is different from the sampling frequency in the preceding header, for example, the operating parameters of the DA converter downstream from the decoding means must be changed. Furthermore, because a correct audio signal will not be produced while the DA converter settings are being changed, the output audio signal will contain noise. As a result, audio output is muted for the time required to change the DA converter settings. Audio is therefore muted for the frame containing the header with the changed setting and one or more subsequent frames.

The header is detected by detecting a synchronization word ("syncword"), which is set and used for synchronization with the header.

This syncword is further described in Japanese Unexamined Patent Application Publication 2000-31942.

Japanese Unexamined Patent Application Publication H10-209876 teaches a muting process that detects lost data by comparing the data size to apply muting. The conventional bitstream playback apparatus taught in Japanese Unexamined Patent Application Publication H10-209876 decodes an audio stream encoded to the MPEG-1 or MPEG-2 Audio standard, detects a frame buffer underflow in the decoder when part of the bitstream is lost for any reason, and thus mutes output. More specifically, this apparatus detects the syncword to find valid headers, and counts the data between one valid header and another valid header. If the counted data size F is less than a predetermined size, data loss is detected and muting is applied.

SUMMARY OF INVENTION

The elementary stream used by the present invention does not contain a syncword and has no bits for CRC or other type of error checking. Problems confronted when processing this type of elementary stream, however, include how to find discontinuities in the bitstream and when (what timing) to apply muting.

The problems with the methods and apparatuses cited above in this regard are described below.

Japanese Unexamined Patent Application Publications 2000-259195 and 2000-31942 detects valid headers and interprets information written in valid headers, and thus cannot find discontinuities in the data between one header and the next header.

Japanese Unexamined Patent Application Publication H10-209876 detects a valid header and detects the amount of data between that valid header and the next valid header. While valid headers can be found using the syncword, two consecutive valid headers cannot be found when processing a stream that does not contain syncwords, that is, the type of stream to which the present invention is directed.

Furthermore, muting is applied to frames following the header where a change is detected with the apparatus taught in Japanese Unexamined Patent Application Publication 2000-259195. As a result, noise caused by discontinuities in the bitstream before a parameter change is detected cannot be muted.

Yet further, Japanese Unexamined Patent Application Publication H10-209876 also does not describe the timing at which muting is applied.

To resolve these problems, a playback apparatus according to the present invention receives data having a lower layer second stream contained in an upper layer first stream that includes a detectable header signal, the second stream containing an encoded audio signal and a private header storing attribute information for the encoded audio signal in one frame but not containing a synchronization word, decodes the encoded audio signal, and outputs audio. This playback apparatus has a stream analyzing means for analyzing the first stream and detecting the header signal, analyzing the second stream based on the detected header signal, and outputting the encoded audio signal and private header address; a pre-decoding buffer memory for temporarily storing the encoded audio signal and private header output from the stream analyzing means; a decoding means for decoding the encoded audio signal input from the pre-decoding buffer memory and outputting audio; a first header analyzing means for analyzing attribute information contained in the private header of a first frame, and detecting data length information denoting the data length of the encoded audio signal following the private header; a second header analyzing means for analyzing target data of a specified length starting from an address acquired by adding the detected data length to the address of the private header of the first frame, and determining if the target data is the attribute information contained in the private header of a second frame; and a control means for stopping audio output from the decoding means for at least the encoded audio signal of the first frame if the analyzed target data is determined to not be attribute information contained in the private header of a second frame.

Preferably, the second header analyzing means determines if at least a part of the target data matches at least a part of the attribute information interpreted by the first header analyzing means.

Alternatively, the second header analyzing means determines if at least a part of the target data matches at least a part of a previously stored attribute information set.

The attribute information is preferably at least one of the following: a sampling frequency of the encoded audio signal, channel information, audio sample bit length, and encoded audio signal data length.

Yet further preferably, the stream analyzing means detects frame length data contained in the header signal denoting the length of the frame, and abandons the frame and analyzes the next frame when the length of the data in the one frame following the header signal is not equal to the detected frame length data.

Alternatively, the first stream contains a plurality of packets, and the stream analyzing means detects packet length data contained in the header signal denoting the packet length, and abandons a packet and analyzes the next packet when the length of the detected packet is not equal to the detected packet length data.

Further preferably, a discontinuity identification packet is inserted in the first stream where a data discontinuity occurs, and when the stream analyzing means detects a discontinuity identification packet and the length of data output to the pre-decoding buffer memory before the discontinuity identification packet is less than a predefined data length or integer multiple thereof, the stream analyzing means outputs padding data equal to the data deficiency to the pre-decoding buffer memory.

Alternatively, a discontinuity identification packet is inserted in the first stream where a data discontinuity occurs; and the stream analyzing means comprises a counter for counting from a detected header signal to a discontinuity identification packet. The playback apparatus also has an address storage means for calculating and storing the address where the counter stops counting; and the control means moves a read pointer so that the next private header is located at the calculated address.

Yet further preferably, the playback apparatus also has a delay means between the pre-decoding buffer memory and decoding means.

Another aspect of the present invention is a playback method for receiving data having a lower layer second stream contained in an upper layer first stream that includes a detectable header signal, said second stream containing an encoded audio signal and a private header storing attribute information for the encoded audio signal in one frame but not containing a synchronization word, decoding said encoded audio signal, and outputting audio. This playback method has a stream analyzing step for analyzing the first stream and detecting the header signal, analyzing the second stream based on the detected header signal, and outputting the encoded audio signal and private header address; a step for temporarily storing the encoded audio signal and private header output from the stream analyzing step; a decoding step for decoding the stored encoded audio signal and outputting audio; a first header analyzing step for analyzing attribute information contained in the private header of a first frame, and detecting data length information denoting the data length of the encoded audio signal following the private header; a second header analyzing step for analyzing target data of a specified length starting from an address acquired by adding the detected data length to the address of the private header of the first frame, and determining if said target data is the attribute information contained in the private header of a second frame; and a control step for stopping audio output from the decoding step for at least the encoded audio signal of the first frame if the analyzed target data is determined to not be attribute information contained in the private header of a second frame.

Preferably, the second header analyzing step determines if at least a part of the target data matches at least a part of the attribute information interpreted by the first header analyzing step.

Alternatively, the second header analyzing step determines if at least a part of the target data matches at least a part of a previously stored attribute information set.

The attribute information is preferably at least one of the following: a sampling frequency of the encoded audio signal, channel information, audio sample bit length, and encoded audio signal data length.

Further preferably, the stream analyzing step detects frame length data contained in the header signal denoting the length of the frame, and abandons the frame and analyzes the next frame when the length of the data in the one frame following the header signal is not equal to the detected frame length data.

Alternatively, the first stream contains a plurality of packets, and the stream analyzing step detects packet length data contained in the header signal denoting the packet length, and abandons a packet and analyzes the next packet when the length of the detected packet is not equal to the detected packet length data.

Further preferably, a discontinuity identification packet is inserted in the first stream where a data discontinuity occurs, and when the stream analyzing step detects a discontinuity identification packet and the length of data stored before the discontinuity identification packet is less than a predefined data length or integer multiple thereof, the stream analyzing step outputs padding data equal to the data deficiency to the pre-decoding buffer memory.

Alternatively, a discontinuity identification packet is inserted in the first stream where a data discontinuity occurs; and the stream analyzing step counts from a detected header signal to a discontinuity identification packet. This playback method also has an address storage step for calculating and storing the address where counting stops; and the control step moves a read pointer so that the next private header is located at the calculated address.

Yet further preferably, the playback method also has a delay step for delaying the encoded audio signal between the storing step and decoding step.

A further aspect of the present invention is a program for executing the playback method of the invention on a computer.

Another aspect of the present invention is a computer-readable recording medium for recording a program for executing the playback method of the invention on a computer.

A playback apparatus according to the present invention can output audio without producing noise when decoding an audio stream not containing syncwords or CRC bits in the elementary stream even when there is a discontinuity in the bitstream due to editing or data is lost due to an error on the transmission path.

Other objects and attainments together with a fuller understanding of the invention will become apparent and appreciated by referring to the following description and claims taken in conjunction with the accompanying drawings.

BRIEF DESCRIPTION OF DRAWINGS

FIG. 5A is a block diagram of an audio playback apparatus according to a first embodiment of the present invention;

FIG. 5B is a block diagram of an audio playback apparatus according to a first embodiment of the present invention;

FIG. 7A is a flow chart of an audio playback method according to a second embodiment of the present invention;

FIG. 7B is a flow chart of an audio playback method according to a second embodiment of the present invention;

FIG. 9A is a flow chart of an audio playback method according to a third embodiment of the present invention; and FIG. 9B is a flow chart of an audio playback method according to a third embodiment of the present invention.

DETAILED DESCRIPTION OF THE INVENTION

A first embodiment of the present invention is described below with reference to FIG. 1, FIG. 2A, FIG. 2B, FIG. 3, FIG. 4, FIG. 5A, and FIG. 5B.

Figure 1:
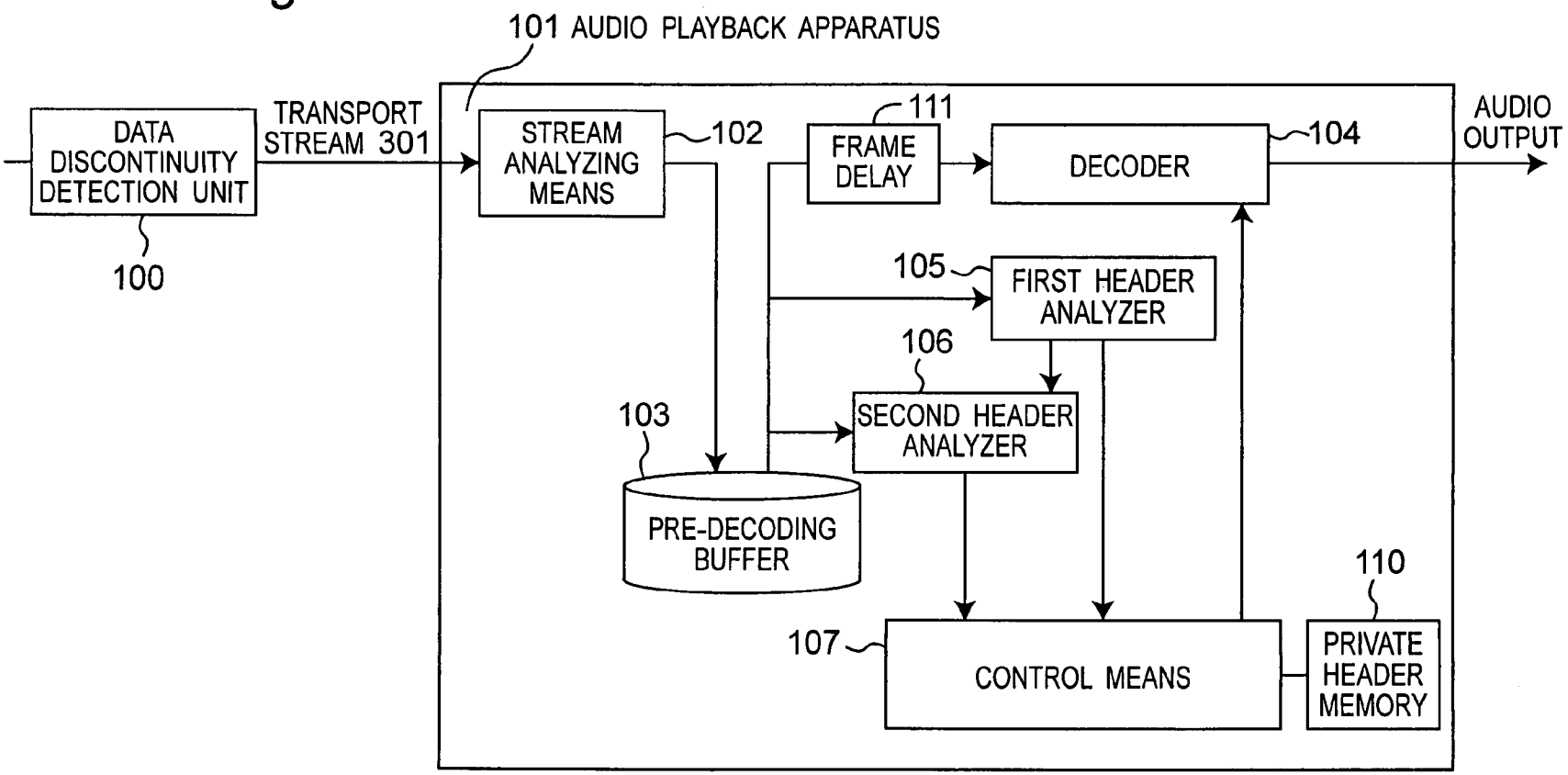
FIG. 1 is a block diagram of an audio playback apparatus according to a first embodiment of the present invention.
Figure 2A:
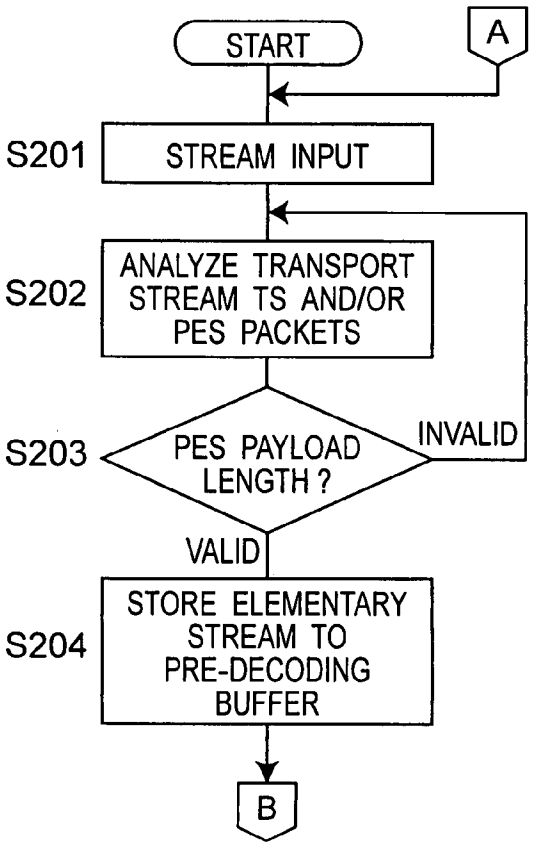
FIG. 2A is a flow chart of an audio playback method according to a first embodiment of the present invention.
Figure 2B:
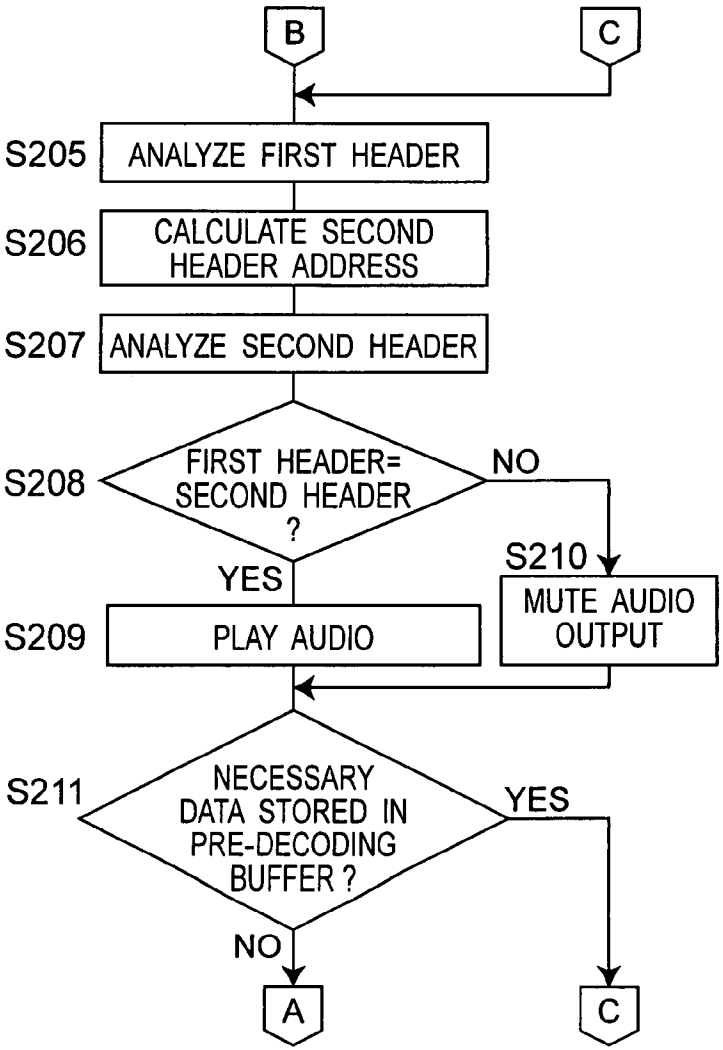
FIG. 2B is a flow chart of an audio playback method according to a first embodiment of the present invention.
Figure 3:
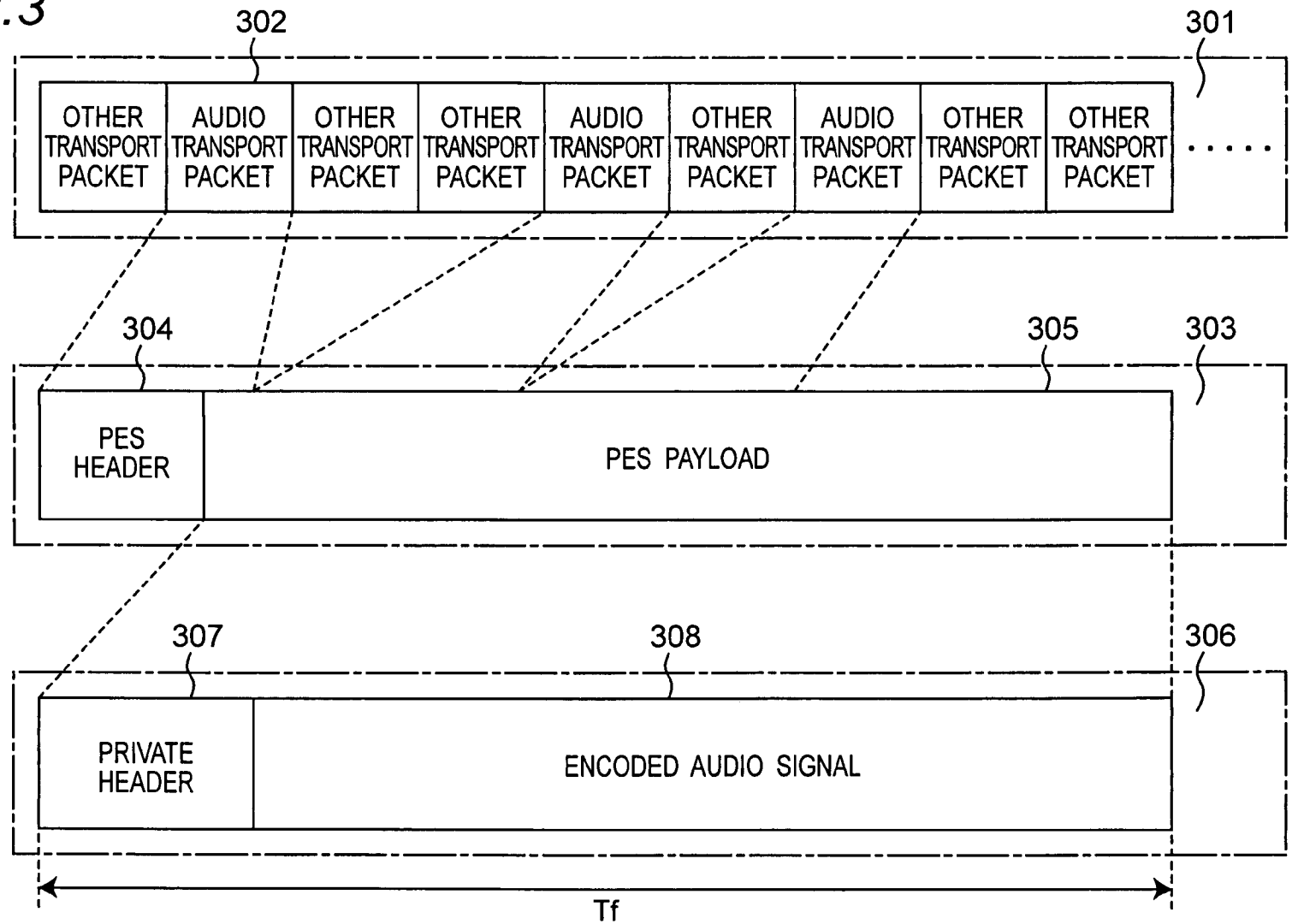
FIG. 3 shows the structure of an MPEG bitstream.
Figure 4:
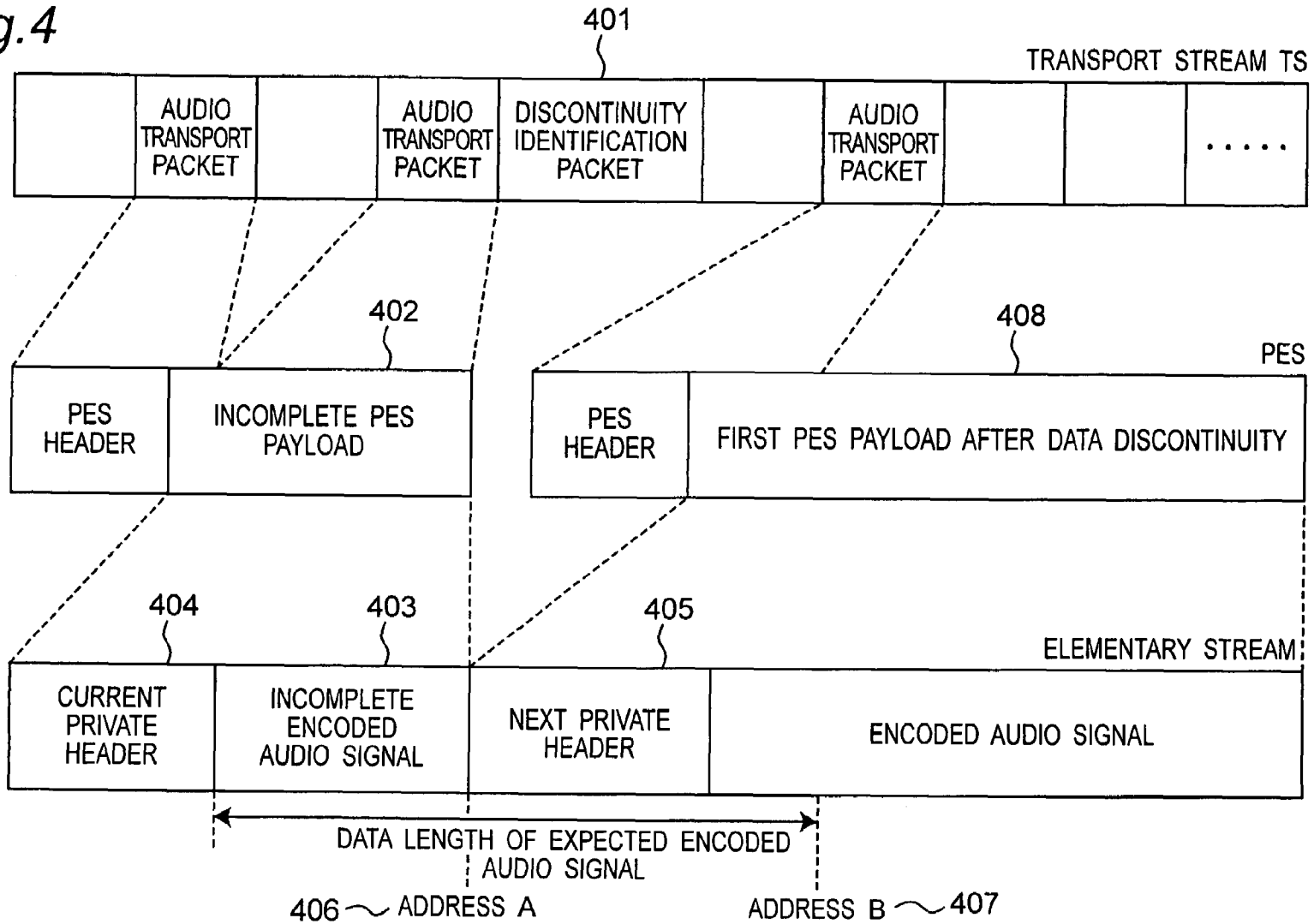
FIG. 4 shows the structure of a bitstream edited at the transport stream packet unit level.

FIG. 1 is a block diagram of an audio playback apparatus 101 according to a first embodiment of the present invention. FIG. 2A and FIG. 2B are a flow chart showing the steps of a playback method used in this first embodiment of the invention. FIG. 3 shows the structure of the bitstream input to the audio playback apparatus 101, and more particularly shows the transport stream and PES packet in an MPEG bitstream, and the structure of the elementary stream processed by the present invention to prevent noise. FIG. 4 shows an example of the bitstream in which the transport stream shown in FIG. 3 is edited at the transport packet level and contains incomplete PES packets.

The process whereby the transport stream 301 is produced on the transmission side is described briefly first.

The source audio signal is converted to an encoded audio signal 308 by a specific encoding method, segmented into blocks of a specified byte length (such as 960 bytes or 1440 bytes), and a four-byte private header 307 is then added to the first block. This encoded audio signal is assumed herein to be uncompressed PCM data. Each segment of the encoded audio signal 308 contains an approximately 5 msec long audio signal. The private header 307 contains attribute information for the encoded audio signal 308, and does not contain a syncword. The private header 307 and following encoded audio signal 308 together form one audio frame, and a stream containing a series of consecutive frames is called an elementary stream 306.

The audio signal attribute data includes, for example, the sampling frequency, channel information, bit length of the samples, and the data length of the encoded audio signal 308. The attribute data does not change unless any of the attributes (that is, the sampling frequency, channel information, bit length of the samples, and the data length of the encoded audio signal 308 in this example) change. Therefore, unless the attribute data changes, the private header 307 of the n-th frame (where n is a positive integer) and the private header 307 of the (n+1)-th frame are the same. Normally there is very little change in the attribute information. The attribute information also includes attributes that change infrequently (including never) and attributes that change frequently. In addition, some attributes that change only change between a number of predefined options. For example, the data length of the encoded audio signal 308 has two predefined choices, 960 bytes and 1440 bytes.

This elementary stream 306 is divided into frame units, which are written to the PES payload 305. The PES payload 305 is thus 964 bytes or 1444 bytes long. A PES header 304 is added to each PES payload 305, thus producing a PES packet 303.

Each PES packet 303 is then segmented into units of a defined length (188 bytes or 184 bytes), and each of these units is called an audio transport packet 302.

The audio transport packets 302 are combined with video transport packets and other transport packets in the transport stream 301.

The transport stream 301 is broadcast from the transmission station. The receiver receives the transport stream 301, and the audio playback apparatus 101 reproduces the audio from the transport stream 301.

The received transport stream 301 could be sent directly to the audio playback apparatus 101, or recorded to some recording medium from which the transport stream 301 is then read and sent to the audio playback apparatus 101 for audio playback. This latter case includes sending an audio transport stream recorded by an audio recording and reproducing apparatus to the audio playback apparatus 101 for playback, and sending commercial content recorded to a disc (such as a DVD) as a transport stream to the audio playback apparatus 101 for playback.

As described above, the present invention processes a data structure in which a lower layer second stream (elementary stream), that does not contain a syncword but includes an encoded audio signal and a private header storing attributes of the encoded audio signal in one frame, is contained in an upper layer first stream (the PES packet stream) that includes a detectable header signal (PES header).

A data discontinuity detection unit 100 detects whether there are any packet discontinuities in the stream or any data discontinuities in the packets of the received stream, that is, whether any data was lost, and inserts a discontinuity identification packet 401 if a discontinuity is found.

The audio playback apparatus 101 decodes the input transport stream 301 containing audio transport packets 302 and outputs an audio signal. The transport stream 301 input to the audio playback apparatus 101 is input to the stream analyzing means 102 (S201). The stream analyzing means 102 analyzes the transport stream 301, extracts the audio transport packets 302 and assembles the PES packets 303, and then analyzes the PES packets 303 (S202).

As shown in FIG. 3, the stream analyzing means 102 extracts only the audio transport packets 302 from the transport stream packet stream, and assembles the PES packet 303 stream. The PES header 304 contains the data length of the PES payload 305. Once the PES header 304 is detected, the stream analyzing means 102 therefore starts counting from the beginning of the PES payload immediately following the PES header, and stops counting when the next packet (either PES packet or the discontinuity identification packet described below) is found. If there is no data discontinuity, this count will equal the data length of the PES payload 305. The count is therefore compared with the data length value read from the PES header to determine if the count matches a predefined valid value (S203). If the values do not match, that is, if the data length is not valid (S203 returns INVALID), the PES packet being analyzed is dropped and the next PES packet is analyzed.

Note that the data length of the PES payload is one of multiple values predefined by the coding standard, and in this example is either 964 bytes or 1444 bytes.

If the data length is valid (S203 returns VALID), the private header 307 and encoded audio signal 308 are extracted from the PES payload 305 and stored to the pre-decoding buffer 103 (S204). Note that the PES payload 305 is also referred to herein as the elementary stream 306. The private header 307 also includes the attributes of the encoded audio signal 308, but does not contain a syncword. The private header 307 is detected after a specified delay from PES header 304 detection, for example. In the example shown in FIG. 3, the private header 307 is located directly after the PES header 304, but the private header 307 could be located a specified distance from the end of the PES header 304. In this case, the PES header also contains information indicating the distance from the end of the PES header 304 to the private header 307.

The stream analyzing means 102 thus functions to analyze the stream containing the PES packets, that is, the first stream, and detect the header signal (PES header), and analyze the second stream (elementary stream) based on the detected header signal to output the encoded audio signal and private header location information.

Note, further, that the transport stream 301 is input to the audio playback apparatus 101 in this example, but the invention shall not be so limited and the audio PES packets 303 could be input. In this case, the stream analyzing means 102 still stores the private header 307 and encoded audio signal 308 of the elementary stream 306 to the pre-decoding buffer 103. Note also that transport stream 301 analysis and PES packet 303 analysis are shown in one step S202 in FIG. 2A for clarity.

The encoded audio signal 308 output from the pre-decoding buffer 103 is then input to the first header analyzer 105, second header analyzer 106, and frame delay 111. The frame delay 111 delays the received encoded audio signal 308 at least one frame before passing the encoded audio signal 308 to the decoder 104.

The first header analyzer 105 detects and reads the private header 307 in the first frame stored to the pre-decoding buffer 103, and analyzes and outputs the information contained in the private header 307 to the control means 107 (S205).

The private header 307 is detected at a specified time after the PES header 304 detected by the stream analyzing means 102, for example. The information contained in the private header 307 is the attribute information for the encoded audio signal, including, for example, the sampling frequency, channel information, bit length of the audio samples, and the data length of the encoded audio signal 308. All or part of the attribute information is output to the control means 107.

The first header analyzer 105 detects the n-th private header 307 (4 bytes), and sends the detected n-th private header 307 to the control means 107. The control means 107 stores all or part of the information in the n-th private header 307 (that is, the sampling frequency, channel information, bit length of the audio samples, and the data length of the encoded audio signal 308) in the private header memory 110.

The first header analyzer 105 also counts time Tf, which is equivalent to the length of one frame, from the beginning of the detected n-th private header 307, and then sends a trigger signal to the second header analyzer 106. The first header analyzer 105 could alternatively send the trigger signal after counting m frames (where m is a positive integer greater than 1) instead of counting only one frame.

This time Tf is determined by adding the private header length (4 bytes) to the data length of the encoded audio signal 308, which is included in the attribute data. Counting is done by counting the data length of the encoded audio signal 308 from the end of the private header 307.

As will be known from the foregoing description, the first header analyzer 105 analyzes the attribute information contained in the private header of the first frame, and detects the data length information denoting the length of the encoded audio signal following the private header.

In response to the trigger signal, the second header analyzer 106 reads a part (4 bytes) of the elementary stream data output from the pre-decoding buffer 103, that is, reads the target data. If there is no discontinuity in the encoded audio signal, the read target data will be the (n+1)-th private header. If there is a discontinuity in the n-th frame data, the read target data will not be the (n+1)-th private header, and the (n+1)-th private header can therefore not be read correctly.

The second header analyzer 106 compares the read 4-byte target data with the private header stored in the private header memory 110. If the target data and the stored private header are the same, the second header analyzer 106 knows that the (n+1)-th private header is in the correct position, that is, that the n-th frame is neither longer nor shorter than the correct length. The control means 107 therefore proceeds with audio decoding.

However, if the target data does not match the private header stored in the private header memory 110, the second header analyzer 106 knows that the (n+1)-th private header is not in the correct position, therefore knows that there is a discontinuity in the encoded audio signal, and knows that some audio data is missing. The control means 107 therefore outputs a mute signal to the decoder 104 in order to mute the encoded audio signal following the n-th private header. Because a frame delay 111 is provided, the mute signal will be output immediately before the decoder 104 outputs the audio for the encoded audio signal following the n-th private header. The decoder 104 thus mutes the encoded audio signal following the n-th private header, and stops audio output. The mute signal mute the audio for one frame period. As a result, audio output resumes from the encoded audio signal following the (n+1)-th private header.

As will be known from the foregoing description, the second header analyzer 106 analyzes target data of a specific length following the position determined by adding the detected frame length to the location of the private header in the first frame, and determines if the analyzed target data is the attribute information contained in the private header of the second frame.

Whether this target data is the attribute information contained in the private header of the second frame can be determined by detecting if at least a part of the target data matches at least a part of the attribute information analyzed by the first header analyzer 105 from the first frame.

Furthermore, the mute signal could be a signal for muting a plurality of frame periods, such as a signal for muting two frame periods. If the mute signal mutes audio output for two frame periods, audio output is interrupted to mute the encoded audio signal following the (n+1)-th private header, and audio output resumes from the encoded audio signal following the (n+2)-th private header.

The private header memory 110 could also be rendered in the first header analyzer 105.

It will also be obvious that the control means 107 could calculate the header address instead of the first header analyzer 105.

Similarly to the first header analyzer 105, the second header analyzer 106 analyzes the private header 307 and outputs the information contained therein to the control means 107 (S207). The second header analyzer 106 differs from the first header analyzer 105 in that the second header analyzer 106 reads data at the trigger signal from the first header analyzer 105, and analyzes the private header in a frame chronologically after the private header analyzed by the first header analyzer 105, specifically the private header of the next frame in this example. In this example, therefore, the second header analyzer 106 analyzes the private header of the next frame after the current frame being decoded by the decoder 104.

The decoder 104 reads the encoded audio signal 308 output ROM the pre-decoding buffer 103 after a specific delay, and outputs the audio (S209). The control means 107 controls audio output from the decoder 104, specifically starting and stopping decoding and muting audio output.

The control means 107 receives the private header information for the current and next frames from the first header analyzer 105 and second header analyzer 106 and compares the received information as described above (S208). If the compared information is not the same, the control means 107 instructs the decoder 104 to mute audio output (S210).

The playback apparatus and playback method according to this embodiment of the invention detect if sufficiently more than one frame of the encoded audio signal data has accumulated in the pre-decoding buffer (S211) so that the next frame can be decoded after outputting the audio signal from the first frame. If sufficient data is buffered (S211 returns yes), the procedure loops back to step S205 for the first header analyzer 105 to analyze the attribute information in the first frame, and decoding continues. If sufficient data is not stored in the buffer (S211 returns no), the procedure loops back to step S201 for stream input from an external source, and operation continues from stream analysis by the stream analyzing means 102 (S202).

Operation when the transport stream 301 has been edited at the transport packet level is described next with reference to FIG. 4.

When there is a discontinuity in the transport stream input to the audio playback apparatus 101 due to editing, for example, the data discontinuity detection unit 100 inserts a discontinuity identification packet 401 at the place where the discontinuity was detected. The stream analyzing means 102 then analyzes the input stream as described above (S202), and writes the audio elementary stream to the pre-decoding buffer 103 (S204). If a discontinuity identification packet 401 has been inserted, the encoded audio signal extracted from the stream will be an incomplete encoded audio signal 403 containing no data in the later part of the signal.

The first header analyzer 105 then adds the data length of a valid encoded audio signal contained in the first header analyzer 105 to the end address of the current private header, and thus calculates address B 407 (S206). Because of this incomplete encoded audio signal 403, however, address B 407 is at a point later than the actual address A 406 of the next private header. When the first header analyzer 105 then outputs the trigger signal at the timing of address B, the second header analyzer 106 reads the specified length of data (4 bytes) from address B as described above, and runs the private header analysis process expecting to find the next private header (S207). However, because the specified amount of data (4 bytes in this example) stored from address B is either part of the encoded audio signal or part of the private header and part of the encoded audio signal, the private header cannot be correctly interpreted. As a result, the information read by the second header analyzer 106 does not match the attribute information acquired by the first header analyzer 105 and stored in the private header memory 110, and a mismatch results (S208 returns no). If the encoded audio signal is PCM data, the data read by the second header analyzer 106 could possibly match the private header data from the first frame, but this would be very rare.

Because of the detected data mismatch, the current frame related to the current private header 404 is muted before the audio is output from the decoder 104 (S210). As a result, the incomplete encoded audio signal 403 and if necessary the encoded audio signal following in the next frame are neither decoded nor output, and the output of audio noise is thus prevented.

Another evaluation method run by the control means 107 is described next with reference to FIG. 5A and FIG. 5B. The private header memory 110 in this method does not store the attribute information read from the detected private header (that is, the sampling frequency, channel information, bit length of the audio samples, and the data length of the encoded audio signal 308), but instead stores the complete set of selectable attribute information, including variations. More specifically, the private header memory 110 stores information such as shown in Table 1 below.

TABLE 1

| a: sampling frequency | b: audio type | c: bit length of sample | d: data length of encoded audio signal |
|---|---|---|---|
| (a1) 32 kHz | (b1) mono | (c1) 16 | (d1) 960 bytes |
| (a2) 44.1 kHz | (b2) stereo | (c2) 20 | (d2) 1440 bytes |
| (a3) 48 kHz | (b3) dual mono | (c3) 24 | (d3) 5760 bytes |

The information actually contained in the private header includes one value from each of columns a to d, for example, (a2, b1, c1, d2).

The control means 107 compares the attribute information detected from the current private header and the attribute information set previously stored in the private header memory 110 (that is, the data in Table 1), and determines if information matching the detected attribute information is stored in private header memory 110 (S507). That is, if all of the detected attributes (a2, b1, c1, d2) are included in the attribute information set stored in the private header memory 110, the control means 107 determines that the information is valid. However, if any one of the values in the detected attribute information is not included in the attribute information set stored in the private header memory 110, the control means 107 determines that the information is not valid. For example, if the detected attributes are (xx, b1, c1, d2) (where xx denotes information that cannot be interpreted as an attribute value), the private header is determined to be invalid.

The four bytes of target data following the length of the expected encoded audio signal 308 from the end of the current private header, that is, the information detected from the location where the next private header should be located, is then compared with the previously stored attribute information using the same method applied in step S507 (S508). If all of the detected attributes are included in the attribute information set stored in the private header memory 110, the information is valid and the audio is reproduced (S509). However, if any one of the detected attribute values does not match the previously stored attribute information, the decoder 104 is instructed to mute the audio output (S510).

The step of determining if the PES payload length is correct (step S203 shown in FIG. 2A) is omitted in FIG. 5A for clarity, but it will be obvious to one with ordinary skill in the related art that the PES payload length can be evaluated as described above after the stream analysis step (S502).

Furthermore, because whether to mute the audio output can be determined based on whether the next private header is in the correct location or not, decision diamond S507 can be omitted. In this case, only the attribute information detected from the next private header is compared for a match with the previously stored attribute information (S508). The current private header is detected and interpreted to determine the starting point for counting to the next private header and the distance to the next private header. The next private header is analyzed to determine if the data detected as the next private header is a correctly formed private header.

As described above, the second header analyzer determines if the target data is the attribute information contained in the private header of the second frame, but this determination could be based on whether at least a part of the target data matches at least a part of the previously stored attribute information set.

Storing an attribute information set such as shown in Table 1 prevents determining that the detected attributes are wrong when the attributes are changed within the allowed range.

Note that because the private header 307 in an audio stream frame generally includes attributes relating to the encoded audio signal 308 following thereafter, the last frame in the stream may not contain any data to be analyzed by the second header analyzer 106.

In this case, the stream analyzing means 102 adds predefined dummy data to the end of the stream. This dummy data could be, for example, a typical combination of the attribute information shown in Table 1, such as (a1, b1, c1, d1). The purpose of this dummy data is to ensure that all of the attribute information in the next frame acquired by the second header analyzer 106 matches a predefined bit sequence, and thus prevent the control means 107 from instructing the decoder 104 to mute the audio output. This effectively avoids the second header analyzer 106 being unable to interpret any data because a buffer underflow occurs when the decoder reads data from the pre-decoding buffer 103 as a result of there being no data to be interpreted by the second header analyzer 106 at the expected address at the end of the input stream.

More specifically, a buffer underflow is avoided by the stream analyzing means 102 adding a private header containing predefined valid attribute information, and the last frame can therefore be decoded and output. The predefined attribute information could be, for example, only a sampling frequency of 48 kHz; or a sample bit length of 16 bits, 20 bits, or 24 bits; or an audio type of monaural, dual monaural, or stereo; or an encoded audio signal data length of 960 bytes or 1440 bytes. The specific bit sequence added to the end of the bit stream is any bit sequence that will not be mistaken for the attribute information. Alternatively, the specific bit sequence added to the end of the bit stream could be a bit sequence representing the predefined valid attribute information.

This embodiment of the invention prevents producing audio noise by muting the encoded audio signal of the first frame when part of the encoded audio signal in the first frame, which is the data between the private header of a first frame and the private header of a second frame, is missing due to a transmission error, for example.

Figure 6:
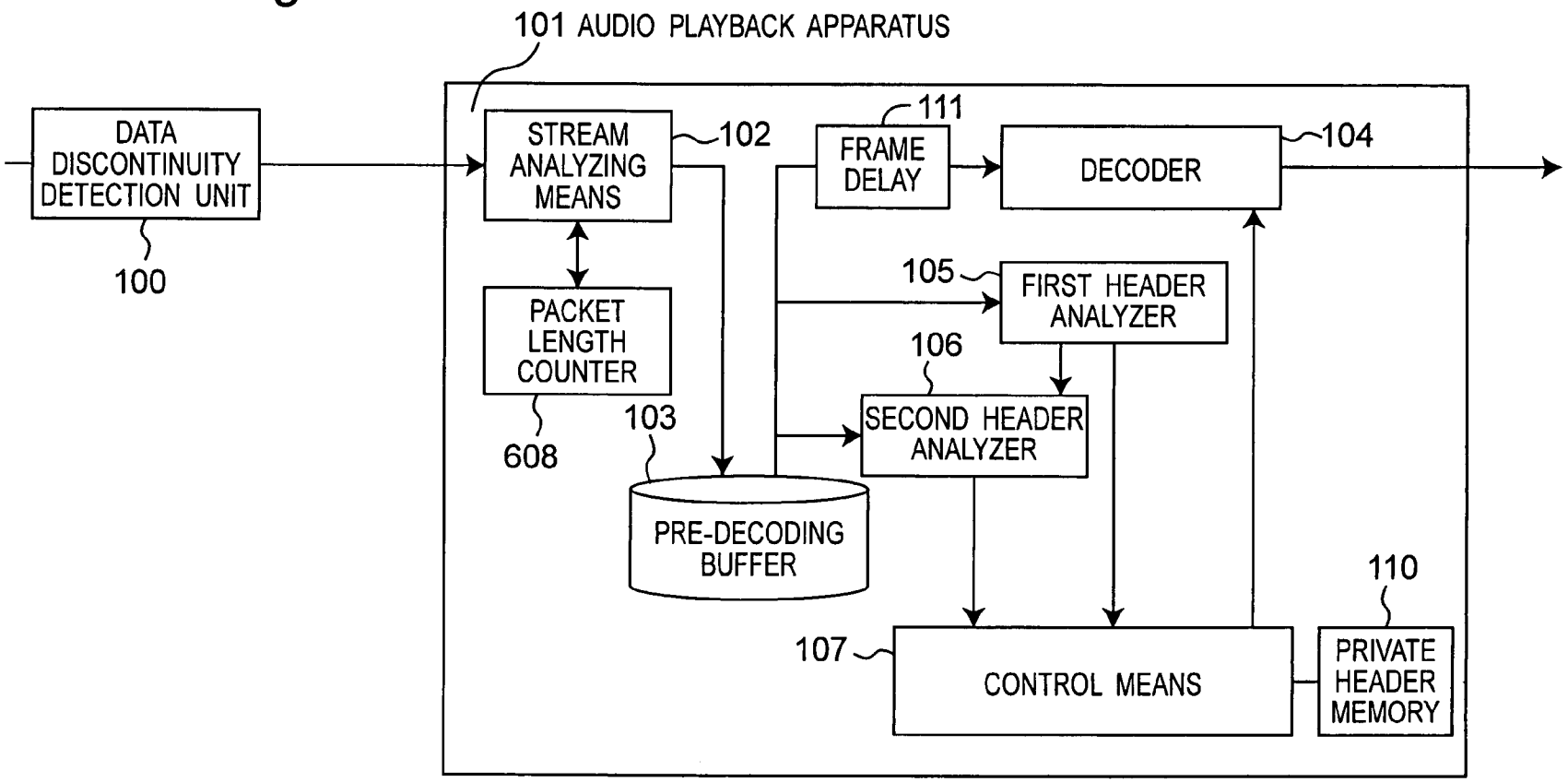
FIG. 6 is a block diagram of an audio playback apparatus according to a second embodiment of the present invention.
Figure 8:
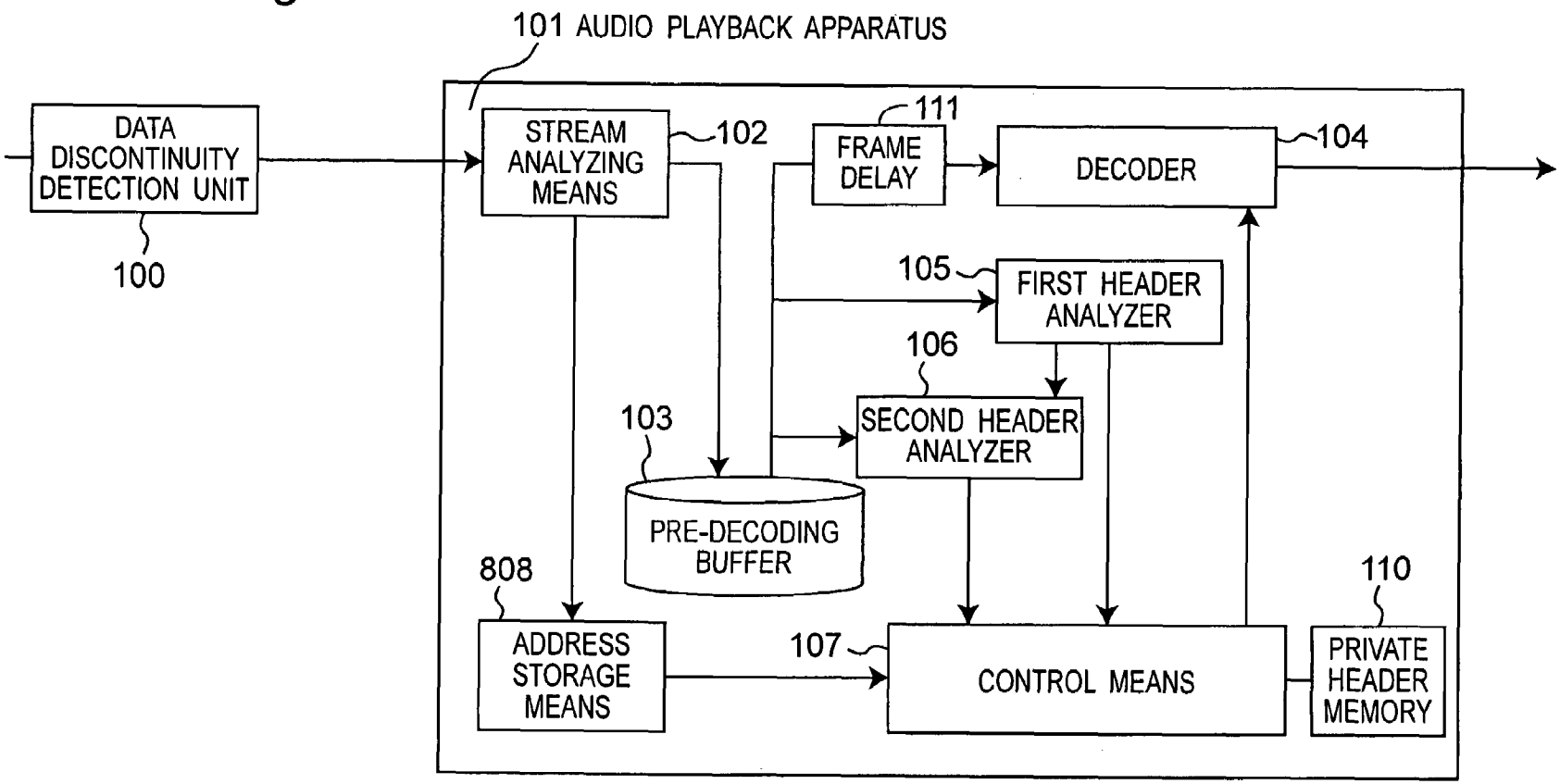
FIG. 8 is a block diagram of an audio playback apparatus according to a third embodiment of the present invention.

A second embodiment of the present invention is described next with reference to FIG. 6, FIG. 7A, and FIG. 7B.

This second embodiment of the invention differs from the first in that a packet length counter 608 is also provided. This packet length counter 608 continually counts the length of data stored in pre-decoding buffer 103 (S705). If the counted length of the PES payload is less than a first specified length (S706 returns no), control returns to the stream input step (S701).

After interpreting the transport stream TS and PES header (S702), this embodiment of the invention determines if a discontinuity identification packet is present (S703). If a discontinuity identification packet is detected (S703 returns yes), whether the length of the elementary stream stored in the pre-decoding buffer 103 is an integer multiple of a second specified length is determined (S707). If not (S707 returns no), padding data is stored to the pre-decoding buffer 103 so that the amount of data stored in the pre-decoding buffer 103 is an integer multiple of the second specified length (S708). The packet length counter 608 is then reset (S716) and operation returns to the stream input step S701.

If a discontinuity identification packet is not detected (S703 returns no), the elementary stream is stored to the pre-decoding buffer 103 (S704) and the packet length counter 608 counts the length of the stored data (S705).

The packet length counter 608 counts the length of the PES payload (S705). More specifically, the packet length counter 608 counts how much data is stored to the pre-decoding buffer 103 between when the stream analyzing means 102 detects the header of a first audio PES packet (the PES header) (S702) and detects the header of the next PES header.

If the stream analyzing means 102 detects a discontinuity identification packet while interpreting the transport stream TS or PES header (S703 returns yes), the stream analyzing means 102 determines if the data stored to the pre-decoding buffer 103 by that time is the integer multiple of the second specified length (S707). If not (S707 returns no), padding data is stored to the pre-decoding buffer 103 so that the amount of data stored in the pre-decoding buffer 103 is the integer multiple of the second specified length (S708). The packet length counter 608 is then reset (S716) and operation returns to the stream input step S701. When operation returns to step S701, the read address of the first header analyzer 105 in the pre-decoding buffer 103 is reset to the next address after the address to which the padding data was stored, that is, to the address of the beginning of the data following the discontinuity identification packet.

The predefined first specified length used in this process is, for example, 968 bytes or 1448 bytes, that is, an amount equal to the first private header (4 bytes), the length of the encoded audio signal (940 bytes or 1440 bytes), and the second private header (4 bytes).

The second specified length is the smallest unit of data (normally called a "word") that can be accessed by the first header analyzer 105, second header analyzer 106, and decoder 104 when reading data stored in the pre-decoding buffer 103, and in this example is 4 bytes.

The elementary stream output from the pre-decoding buffer 103 is interpreted by the first header analyzer 105 as described above (S709), the location of the second header is calculated (S710), and the target data at the second header location (that is, the data expected to be the second header) is interpreted (S711). The content of the interpreted target data is compared with the content of the first header to determine if they match (S712). If they are the same, the target data content is recognized as a valid second header, and the audio is reproduced and output (S713). However, if the content of the second header differs from the content of the first header in any part, the target data content is not recognized as a correctly formed second header. More specifically, the location of the second header is known to be offset from the calculated second header address. In this case, as in the first embodiment, the encoded audio signal following the first header is muted (S714).

Whether a specified amount of data (which is greater than or equal to the first specified length) is stored in the pre-decoding buffer 103 is then determined (S715). If the data is buffered (S715 returns yes), operation returns to step S709, otherwise operation returns to step S701.

Step S712 above compares the content of the interpreted target data with the content of the interpreted first header and determines if they match. Step S712 could, however, compare the content of the interpreted target data with the content of previously stored data such as shown in Table 1.

When the stream is edited at the transport packet level such that data is removed from the PES payload, that is, the private header of the audio and the encoded audio signal are incompletely formed, the foregoing process prevents the incomplete PES payload, i.e., the incomplete audio frame, from being decoded. An incomplete encoded audio signal preceding the edited segment and the following data are thus prevented from being input to the decoder 104, and noise is thus prevented.

If an incomplete encoded audio signal is not decoded by the decoder 104, the second header analyzer 106 does not need to interpret the next frame (S711) and the control means 107 does not need to verify the attribute information of the next frame (S712). The second header analyzer 106 is provided, however, to detect if data has been dropped in transmission between the stream analyzing means 102 and pre-decoding buffer 103, and to prevent noise when an illegal encoded audio signal is somehow input in PES packets of the normal length.

Alternatively, when the packet length counted by the packet length counter 608 is not an integer multiple of the specified data length (S707 returns no), the stream analyzing means 102 in this second embodiment of the invention could add padding data so that the packet length equals an integer multiple of the specified data length (S708) and the word length is aligned, and then store the padded stream to the pre-decoding buffer 103. The decoder 104, first header analyzer 105, and second header analyzer 106 generally read data from the pre-decoding buffer 103 in predefined word units. For example, four bytes could be read as one word.

When the bitstream is edited at the transport packet level, the bitstream is generally not edited in 4-byte units. As a result, the frame following the point at which the stream was edited is stored to the pre-decoding buffer 103 without the expected word alignment. In this case, the data near the private header read by the first header analyzer 105 and second header analyzer 106 after the edited point is shifted 1 to 3 bytes, and the control means 107 cannot correctly detect the attribute information. This is because the elementary stream to which the present invention is directed does not contain a syncword, and the first header analyzer 105 and second header analyzer 106 therefore cannot detect the 1 to 3 byte offset in the word alignment and thus correct the read address. The stream analyzing means 102 therefore adds padding data when storing data to the pre-decoding buffer 103 (S708), and thus enables decoding and audio output.

The foregoing process is shown in FIG. 7A and FIG. 7B. When a discontinuity identification packet 401 is detected during PES packet analysis, control returns to the PES packet interpreting step S702. If the size of the PES packet stored to the pre-decoding buffer 103 does not equal a first specified length, that is, does not equal an integer multiple of the length of one frame of the elementary stream 306 (S706 returns no), the procedure loops back to the stream input step S701. In addition, if the size of the PES packet stored to the pre-decoding buffer 103 does not equal a second specified length (S707 returns no), padding data is stored to the pre-decoding buffer 103 (S708) to align the pointer for accessing data in the pre-decoding buffer 103 with a full word.

The stream analyzing means in this embodiment of the invention can thus detect data discontinuities in the stream and thereby prevent outputting noise, and can decode the bitstream following a detected discontinuity and reproduce the audio content by aligning the data words at the data discontinuity.

The step of determining if the PES payload length is correct (step S203 shown in FIG. 2A) is omitted in FIG. 7A for clarity, but it will be obvious to one with ordinary skill in the related art that the PES payload length can be evaluated as described above after the stream analysis step (S702).

A third embodiment of the present invention is described next with reference to FIG. 8, FIG. 9A, FIG. 9B, and FIG. 4. This third embodiment of the invention relates to resuming audio output after a point where the bitstream has been edited. This point is referred to herein as the "edited point."

This third embodiment differs from the first and second embodiments by further comprising an address storage means 808 (see FIG. 8) for storing the address of the private header stored by the stream analyzing means 102 to the pre-decoding buffer 103.

After the bitstream is input (S901), the transport stream TS and PES header are interpreted (S902). The PES header is then read and whether a discontinuity identification packet 401 is detected while interpreting the PES header is determined (S903). If a discontinuity identification packet 401 is found, control goes to step S904. If the next PES header is detected without finding a discontinuity identification packet 401 (or if a discontinuity identification packet 401 while counting a specific length from the previous PES header), control goes to step S905. The elementary stream is stored to the pre-decoding buffer 103 in step S905.

Steps S903 and S904 are described further with reference to FIG. 4. In step S903 the stream analyzing means 102 detects and interprets the PES header. A counter in the stream analyzing means 102 starts counting from the end of the PES header and continues counting until the next packet is found (a discontinuity identification packet if there is a discontinuity in the data, and the next PES packet if there is not a discontinuity in the data). When interpreting the PES header, the length of the PES payload following the PES header could be detected, and the detected data length used to control counting. Address A at which counting ends is then calculated. This address A is stored to the address storage means 808 (S904). The starting address of the first private header found after an edited point is thus stored to the address storage means 808.

As described above, the elementary stream output from the pre-decoding buffer 103 is then interpreted by the first header analyzer 105 (S906) and the location of the second header is calculated (S907). The target data at this second header location (that is, the data expected to be the second header) is then interpreted (S908). The target data content is then compared with the content of the first header to determine if they match (S909). If they match, the target data content is recognized as a valid second header, and the audio is reproduced and output (S910). If the content of the second header differs from the content of the first header in any part, the target data content is the target data content is not recognized as a correctly formed second header. More specifically, the location of the second header is known to be offset from the calculated second header address. In this case, as in the first embodiment, the encoded audio signal following the first header is muted (S911).

The read pointer is also reset so that the beginning of the next private header 405 is set to address A stored in the address storage means 808 (S912), and decoding continues. More specifically, address A is read from the address storage means 808, and the read pointers of the first header analyzer 105 and decoder 104 are moved to the starting address of the next header and frame (S912). By thus moving the read pointer the next private header 405 is processed as the foregoing current private header 404, and the next private header thereafter is processed as the next private header.

Whether a specified amount of data (which is greater than or equal to the first specified length) is stored in the pre-decoding buffer 103 is then determined (S913). If the data is buffered (S913 returns yes), operation returns to step S906, otherwise operation returns to step S901.

Step S909 above compares the content of the interpreted target data with the content of the interpreted first header and determines if they match. Step S909 could, however, compare the content of the interpreted target data with the content of previously stored data such as shown in Table 1.

As described above, the stream analyzing means 102 has a counter for counting from a detected header signal to a discontinuity identification packet, and a address storage means 808 calculates and stores the address A where counting stops. The control means 107 then moves the read address so that the next private header is located at the calculated address A.

The step of determining if the PES payload length is correct (step S203 shown in FIG. 2A) is omitted in FIG. 9A for clarity, but it will be obvious to one with ordinary skill in the related art that the PES payload length can be evaluated as described above after the stream analysis step (S902).

This embodiment of the present invention can thus decode and output audio following a data discontinuity caused by editing, for example.

The foregoing embodiments of the present invention are described as the steps of an audio playback apparatus and process, but it will be obvious to one with ordinary skill in the related art that these steps could be executed as part of a computer program or as functional parts of a different apparatus.

Furthermore, the present invention realized as a computer program can be stored to recording media such as a magnetic disk, CD-ROM, or other medium, and thereby easily implemented using a computer system.

INDUSTRIAL APPLICABILITY

The present invention can be used in a playback apparatus or playback method.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The invention claimed is:

1. A playback apparatus for receiving data having a lower layer second stream contained in an upper layer first stream that includes a detectable header signal, the second stream containing an encoded audio signal and a private header storing attribute information for the encoded audio signal in one frame but not containing a synchronization word, decoding the encoded audio signal, and outputting audio, said playback apparatus comprising:

a stream analyzing means for analyzing the first stream and detecting the header signal, analyzing the second stream based on the detected header signal, and outputting the encoded audio signal and private header address;

a pre-decoding buffer memory for temporarily storing the encoded audio signal and private header output from said stream analyzing means;

a decoding means for decoding the encoded audio signal input from said pre-decoding buffer memory and outputting audio;

a first header analyzing means for analyzing attribute information contained in the private header of a first frame, and detecting data length information denoting the data length of the encoded audio signal following the private header;

a second header analyzing means for analyzing target data of a specified length staffing from an address acquired by adding the detected data length to the address of the private header of the first frame, and determining if the target data is the attribute information contained in the private header of a second frame; and a control means for stopping audio output from said decoding means for at least the encoded audio signal of the first frame if the analyzed target data is determined to not be attribute information contained in the private header of a second frame.

2. A playback apparatus as described in claim 1, wherein said second header analyzing means determines if at least a part of the target data matches at least a part of the attribute information analyzed by said first header analyzing means.

3. A playback apparatus as described in claim 1, wherein second header analyzing means determines if at least a part of the target data matches at least a part of a previously stored attribute information set.

4. A playback apparatus as described in claim 1, wherein the attribute information is at least one of the following: a sampling frequency of the encoded audio signal, channel information, audio sample bit length, and encoded audio signal data length.

5. A playback apparatus as described in claim 1, wherein said stream analyzing means detects frame length data contained in the header signal denoting the length of the frame, and abandons the frame and analyzes the next frame when the length of the data in the one frame following the header signal is not equal to the detected frame length data.

6. A playback apparatus as described in claim 1, wherein the first stream contains a plurality of packets, and said stream analyzing means detects packet length data contained in the header signal denoting the packet length, and abandons a packet and analyzes the next packet when the length of the detected packet is not equal to the detected packet length data.

7. A playback apparatus as described in claim 6, wherein a discontinuity identification packet is inserted in the first stream where a data discontinuity occurs, and when said stream analyzing means detects a discontinuity identification packet and the length of data output to said pre-decoding buffer memory before the discontinuity identification packet is less than a predefined data length or integer multiple thereof, said stream analyzing means outputs padding data equal to the data deficiency to said pre-decoding buffer memory.

8. A playback apparatus as described in claim 1, wherein a discontinuity identification packet is inserted in the first stream where a data discontinuity occurs; and said stream analyzing means comprises a counter for counting from a detected header signal to a discontinuity identification packet;

said playback apparatus further comprises an address storage means for calculating and storing the address where the counter stops counting; and said control means moves a read pointer so that the next private header is located at the calculated address.

9. A playback apparatus as described in claim 1, further comprising a delay means between said pre-decoding buffer memory and decoding means.

10. A playback method for receiving data having a lower layer second stream contained in an upper layer first stream that includes a detectable header signal the second stream containing an encoded audio signal and a private header storing attribute information for the encoded audio signal in one frame but not containing a synchronization word, decoding the encoded audio signal, and outputting audio, said playback method comprising:

a stream analyzing step for analyzing the first stream and detecting the header signal, analyzing the second stream based on the detected header signal, and outputting the encoded audio signal and private header address;

a step for temporarily storing the encoded audio signal and private header output from said stream analyzing step;

a decoding step for decoding the stored encoded audio signal and outputting audio;

a first header analyzing step for analyzing attribute information contained in the private header of a first frame, and detecting data length information denoting the data length of the encoded audio signal following the private header;

a second header analyzing step for analyzing target data of a specified length starting from an address acquired by adding the detected data length to the address of the private header of the first frame, and determining if the target data is the attribute information contained in the private header of a second frame; and a control step for stopping audio output from said decoding step for at least the encoded audio signal of the first frame if the analyzed target data is determined to not be attribute information contained in the private header of a second frame.

11. A playback method as described in claim 10, wherein said second header analyzing step determines if at least a part of the target data matches at least a part of the attribute information analyzed by said first header analyzing step.

12. A playback method as described in claim 10, wherein said second header analyzing step determines if at least a part of the target data matches at least a part of a previously stored attribute information set.

13. A playback method as described in claim 10, wherein the attribute information is at least one of the following: a sampling frequency of the encoded audio signal, channel information, audio sample bit length, and encoded audio signal data length.

14. A playback method as described in claim 10, wherein said stream analyzing step detects frame length data contained in the header signal denoting the length of the frame, and abandons the frame and analyzes the next frame when the length of the data in the one frame following the header signal is not equal to the detected frame length data.

15. A playback method as described in claim 10, wherein the first stream contains a plurality of packets, and said stream analyzing step detects packet length data contained in the header signal denoting the packet length, and abandons a packet and analyzes the next packet when the length of the detected packet is not equal to the detected packet length data.

16. A playback method as described in claim 15, wherein a discontinuity identification packet is inserted in the first stream where a data discontinuity occurs, and when said stream analyzing step detects a discontinuity identification packet and the length of data stored before the discontinuity identification packet is less than a predefined data length or integer multiple thereof, said stream analyzing step outputs padding data equal to the data deficiency to said temporary storing step.

17. A playback method as described in claim 10, wherein a discontinuity identification packet is inserted in the first stream where a data discontinuity occurs; and said stream analyzing step counts from a detected header signal to a discontinuity identification packet;

said playback method further comprises an address storage step for calculating and storing the address where counting stops; and said control step moves a read pointer so that the next private header is located at the calculated address.

18. A playback method as described in claim 10, further comprising a delay step for delaying the encoded audio signal between said storing step and said decoding step.

* * * * *

UNITED STATES PATENT AND TRADEMARK OFFICE

CERTIFICATE OF CORRECTION

PATENT NO. : 7,653,538 B2
APPLICATION NO. : 10/544335
DATED : January 26, 2010
INVENTOR(S) : Taro Katayama et al.

It is certified that error appears in the above-identified patent and that said Letters Patent is hereby corrected as shown below:

On the Title page, in item (87) please replace "PCT Pub. Date: Oct. 9, 2004" with --PCT Pub. Date: September 10, 2004--

Signed and Sealed this

Sixth Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,653,538 B2
APPLICATION NO. : 10/544335
DATED : January 26, 2010
INVENTOR(S) : Katayama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1195 days.

Signed and Sealed this

Twenty-third Day of November, 2010

David J. Kappos

David J. Kappos
*Director of the United States Patent and Trademark Office*